United States Patent [19]

Kralik et al.

[11] 4,407,021

[45] Oct. 4, 1983

[54] SUSPENSION SYSTEM FOR HEADGEAR

[75] Inventors: Douglas R. Kralik; Hal D. Mitchell, both of Rolla, Mo.

[73] Assignee: Figgie International Inc., Willoughby, Ohio

[21] Appl. No.: 249,114

[22] Filed: Mar. 30, 1981

[51] Int. Cl.[3] ..... A42B 3/02

[52] U.S. Cl. ..... 2/416

[58] Field of Search ..... 2/416, 411, 413, 414, 2/417–420, 425

[56] References Cited

U.S. PATENT DOCUMENTS

| | | | |
|---|---|---|---|
| 2,585,937 | 2/1952 | Johnson et al. | 2/420 X |
| 3,237,201 | 3/1966 | Morgan | 2/416 X |
| 4,286,339 | 9/1981 | Coombs | 2/414 |

FOREIGN PATENT DOCUMENTS

| | | | |
|---|---|---|---|
| 1193925 | 5/1959 | France | 2/416 |

*Primary Examiner*—Peter P. Nerbun

*Attorney, Agent, or Firm*—Senniger, Powers, Leavitt and Roedel

[57] ABSTRACT

A suspension system for protective headgear comprising a head band adapted to extend around a wearer's head, and a plurality of tension members secured at their outer ends to the headgear adjacent the skirt thereof and at their inner ends to the head band for holding the head band spaced from the inner surface of the headgear. Each tension member is formed of relatively inextensible material with a transversely extending pocket and has a tube of elastomeric material in the pocket enabling extension of the member within a limited range of extension upon tensioning thereof, whereby with the headgear worn by a wearer and upon application of an impact load to the front, back, or sides of the headgear, the headgear moves in the direction of the force with resultant tensioning and elongation of certain of the tension members, the range of elongation of the members being such as to prevent engagement of the headgear with the wearer's head and the tubes in the pockets of the elongated members deforming to attenuate the shock upon the wearer from the applied load.

15 Claims, 3 Drawing Figures

SUSPENSION SYSTEM FOR HEADGEAR

BACKGROUND OF THE INVENTION

This invention involves an improvement in suspension systems for protective headgear of the type, such as shown for example in U.S. Pat. No. 2,250,275, comprising a head band and a length of fabric strip material secured to the shell of the headgear at spaced intervals around the inner surface thereof and to the head band at spaced intervals therealong thereby forming a plurality of tension members which together act to hold the head band spaced from the shell to prevent engagement of the shell with the head on application of an impact load to the headgear. Reference also may be made to coassigned copending U.S. patent application Ser. No. 185,208 disclosing a shock attenuation system for the skirt of protective headgear.

SUMMARY OF THE INVENTION

Among the several objects of this invention may be noted the provision of an improved suspension system for the skirt of protective headgear of the type shown in U.S. Pat. No. 2,250,275; the provision of such a suspension system which provides a relatively high level of shock attenuation for impact loads applied to the headgear; the provision of such a suspension system which stores and then releases at least a portion of the energy of an impact load to increase the time period of the shock from the impact load and thus reduce the magnitude of the shock; the provision of such a suspension system which provides a relatively high level of shock attenuation for repeated impact loads applied during a relatively short time period; the provision of such a suspension system which, if it should suffer a decrease in its shock attenuation capacity in use, is visually detectable as such and may be readily reconditioned; the provision of such a suspension system which is relatively compact and lightweight and allows air to flow into and out of the headgear for enabling ventilation thereof; and the provision of such a suspension system which is relatively simple and economical to manufacture.

In general, the suspension system of this invention comprises a head band adapted to extend around a wearer's head, and a plurality of tension members secured at ends thereof, constituting their outer ends, to the shell of the headgear at spaced intervals around the inner surface of the shell adjacent the skirt thereof and at their inner ends to the head band at spaced intervals therealong for holding the head band spaced from the inner surface of the shell. Each tension member is formed of relatively inextensible strip material, a portion of the strip material being formed for permitting extension and contraction of the tension member and having elastically deformable means associated therewith for enabling extension of the tension member within a limited range of extension upon tensioning thereof, whereby with the headgear worn by a wearer and upon application of an impact load to the front, back, or sides of the headgear, the shell moves in the direction of the force with resultant tensioning and elongation of certain of the tension members, the range of elongation of the tension members being such as to prevent engagement of the shell with the wearer's head and the elastically deformable means of the elongated tension members deforming to attenuate the shock upon the wearer from the applied load, and whereby, upon termination of the impact load, the elongated tension members contract and the shell moves in the opposite direction relative to the head.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
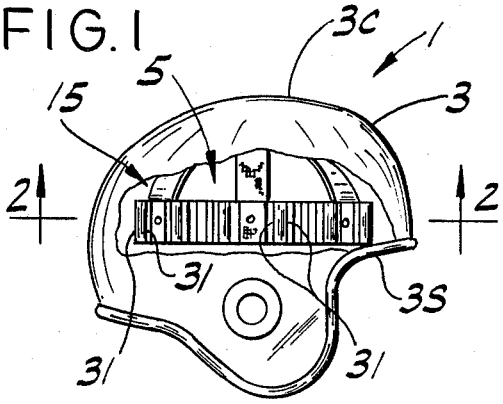
FIG. 1 is a side elevation of protective headgear having an outer shell and a suspension system of this invention within the shell, a portion of the shell being broken away to show certain tension members and a segment of the head band of the suspension system.

Referring to the drawings, there is indicated at 1 headgear, such as a football helmet, comprising an outer protective shell 3 of a suitable relatively lightweight plastic material, such as acrylonitrile-butadiene-styrene (ABS) resin or polypropylene having a relatively high impact resistance. A suspension system of this invention, generally indicated at 5, is secured within the shell, the system comprising a head band 7 adapted to fit around a wearer's head, and a plurality of tension members 9 (e.g., twelve tension members as illustrated). The tension members are secured at ends thereof, constituting their outer ends, to the shell at spaced intervals around the inner surface of the shell adjacent the skirt 3S of the shell by conventional fasteners 11 such as "T" nuts and bolts and at their inner ends to the head band at spaced intervals therealong. The tension members 9 hold the head band 7 spaced from the inner surface of the shell in a manner somewhat similar to that in which spokes hold the hub at the center of a rim of a spoked wheel. However, as distinguished from the spokes of such a wheel, each tension member 9 is formed with a portion permitting extension and contraction of the member. Elastically deformable means 13 is associated with each such portion for enabling extension of the tension member within a limited range of extension, as explained more fully hereinbelow.

To protect the top of the wearer's head a suspension system 15 for the crown 3C of the headgear is also provided. Preferably, this suspension system is of the type disclosed in our copending application Ser. No. 238,230, filed Feb. 26, 1981, comprising a plurality of straps extending up in the shell toward but stopping short of the crown of the shell, each strap being formed with a transversely extending pocket (not shown) permitting extension and contraction of the strap, and having a tube (not shown) of elastically deformable material in the pocket enabling extension of the strap within a limited range of extension and providing shock attenuation for a load applied on the top of the shell. It is also contemplated that conventional suspension systems for the crown of headgear such as those shown for example in U.S. Pat. Nos. 2,250,275 and 3,486,169 also may be incorporated in the headgear 1.

Figure 2:
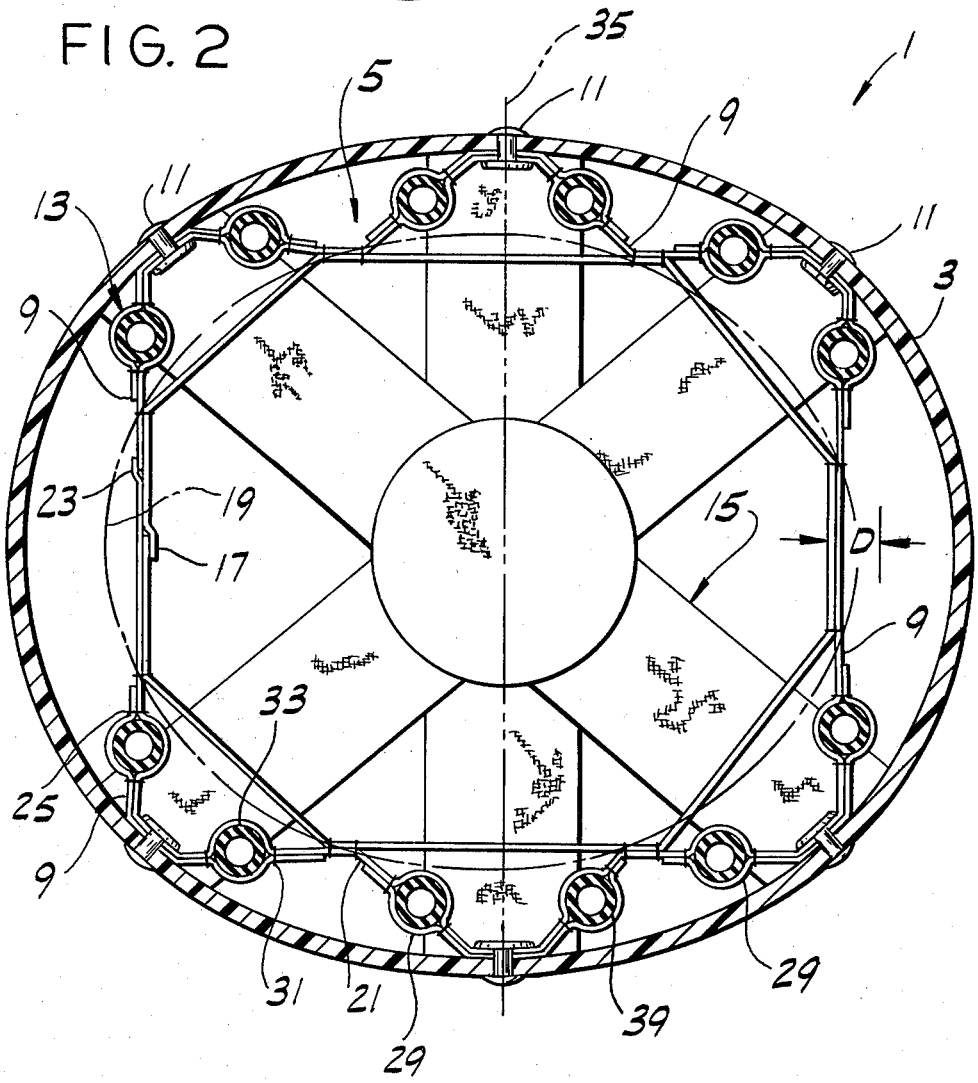
FIG. 2 is an enlarged horizontal section on line 2—2 of FIG. 1 showing the tension members in their contracted condition.

The head band 7 comprises a length of relatively inextensible strip material, such as woven cotton, polypropylene or nylon fabric material, having its ends secured together as by stitching at 17 to form a loop. When the headgear 1 is off the head, the tension members 9 hold the head band 7 in a generally polygonal configuration (i.e., in a 12-sided configuration as appears in FIG. 2). With the headgear on the head, the tension members are elongated, in a manner more fully described hereinafter, so as to allow the head band 7 to assume a generally oval configuration, indicated in phantom at 19 in FIG. 2, conforming to the shape of the head for a snug, comfortable fit of the headgear on the head.

The tension members 9 are constituted of a single relatively long length 21 of the same strip material as the head band with its ends secured together as by stitching at 23 to form a loop. The loop is secured to the shell 3 at spaced intervals around the inner surface thereof by the fasteners 11 and to the head band 7 at spaced intervals therealong as by lines of stitching 25 extending transversely of the head band and the strip 21. The tension members are further constituted of a plurality of relatively short lengths 29 of the strip material, one such length for each adjacent pair of tension members, secured to the strip 21 by lines of stitching 31 extending transversely thereof at spaced intervals therealong to form a pocket 33 for each tension member. The pocket of each tension member constitutes the stated portion thereof permitting extension and contraction of the member. Each tension member 9 extends inwardly from its respective fastener 11 toward the head band 7 at an angle relative to a central vertical plane of the headgear through the fastener (one such plane being indicated at 35) with successive tension members extending at opposite angles relative to central vertical planes of the headgear through respective fasteners 11.

The elastically deformable means 13 for each tension member has a tight fit in its respective pocket 33. When undeformed, it expands the pocket (i.e., holds the sides of the pocket apart) and by reason of being compressible (squeezable) to a generally flattened condition upon the tensioning of the tension member enables extension of the respective tension member 9 within a limited range. Acting together the tension members enable extension of the suspension system 5 within a limited range of extension (the range of extension of the system in one direction being illustrated at D in FIGS. 2 and 3). As described above, upon positioning the headgear on the head, the tension members are slightly elongated and the tubes in the tension members slightly deformed to enable conformance of the head band to the shape of the head. Upon application of an impact load to the sides, back or front of the headgear (one such load being represented by the arrow 37 in FIG. 3), the shell 3 moves in the direction of the force a distance within the range of extension D of the suspension system with resultant tensioning and elongation of certain of the tension members. The elastically deformable means 13 of these elongated tension members deform to attenuate the shock upon the wearer from the applied load. Upon termination of the impact load, the deformable means 13 of the elongated tension members return to their undeformed shape thereby causing the elongated tension members to contract, the shell to move relative to the head in the opposite direction, and the head band to return to the position it normally occupies relative to the shell.

Figure 3:
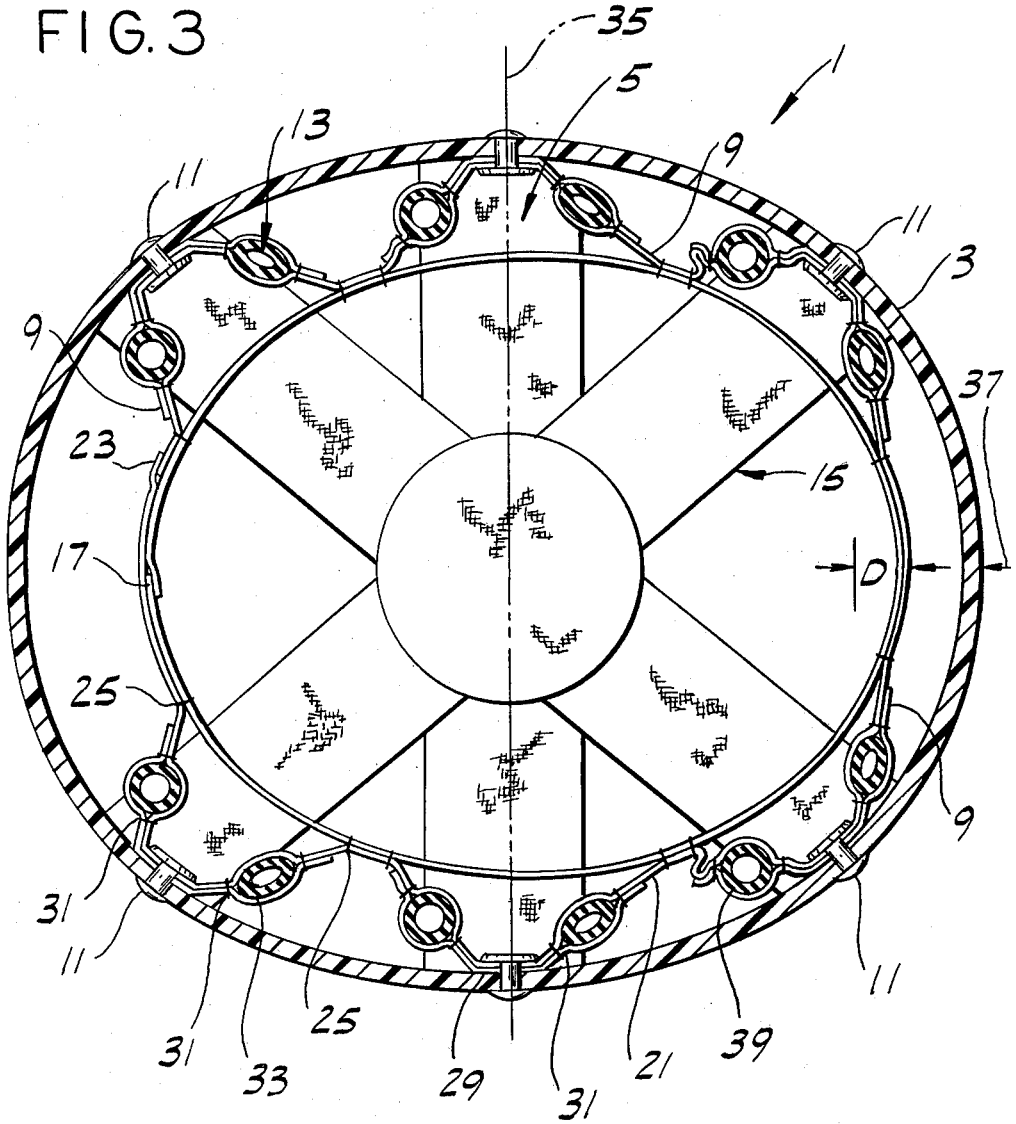
FIG. 3 is a view similar to FIG. 2 showing the head band configured to conform to the wearer's head and certain tension members extended due to the application of an impact load to the headgear.

The elastically deformable means 13 for each tension member comprises a generally cylindrical tube 39 in the respective pocket, the tube being of a suitable elastomeric material, such as polybutylene, polyurethane, polyethylene, a polyarylate resin such as that sold under the trade name "Ardel" by Union Carbide Corp., of New York, N.Y., or a synthetic rubber such as that sold under the trade name "Hytrel" by E. I. Du Pont de Nemours & Co. Inc., of Wilmington, Del. Thus, the tubes in effect constitute elastic plugs in the pockets. As illustrated in FIG. 3, the tubes deform, upon tensioning of the tension members, from circular to elliptical section, the tubes being open at both ends to permit air to flow out of the tubes for such deformation. While the tubes are preferably of circular section when unstressed, it is to be understood that they may be of other shapes in section, such as elliptical or polygonal.

The tubes 39 have an outer diameter or dimension, in their undeformed condition, such as to provide the above-described tight fit in the pockets, while enabling the tubes manually to be pushed out of the pockets. Upon their removal, the tubes may be visually inspected to determined their structure integrity in a manner set forth more fully hereinafter. If the tubes are found to be defective, replacement tubes therefor may be inserted into the pockets.

With the headgear on the wearer's head, the suspension system 5 attenuates the shock upon the wearer from an impact load (such as load 37 applied to the side of the headgear) by distributing the loading over an increased area of the head and by increasing the period of time during which loading is applied to the head, thereby decreasing the shock (which is a time derivative of the loading). Because time is required, upon application of an impact load, for the tension members 9 placed under tension to elongate and to deform (laterally squeeze) their respective tubes 39 from circular to elliptical section, and because time is required, upon termination of the impact load, for the deformed tubes to return to circular section, the overall period of time during which loading is applied to the head is increased and the magnitude of the shock upon the wearer from the impact load is decreased.

By reason of the elasticity of the tubes 39, the suspension system of this invention provides shock attenuation for repeated impact loadings applied during a relatively short period of time, such as may occur during a football game. It is only upon the cracking or fracture of a tube 39, which may occur after a relatively large number of impact loading, that there is a decrease in the level of shock attenuation provided by the suspension system of this invention. The suspension system may be readily inspected to determine if there has been a decrease in its shock attenuation capacity by pushing the tubes 39 out of the pockets 33 and visually inspecting them for cracks and fractures, and may be readily reconditioned by replacing any tubes found to be defective.

While the shock attenuation system of this invention has been shown and described as being incorporated in a football helmet, it is to be understood that it could be incorporated in other protective headgear, such as aviation helmets, military helmets, and industrial hardhats.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A suspension system for the skirt of protective headgear having an outer shell, said system comprising a head band adapted to fit around a wearer's head, and a plurality of tension members secured at ends thereof, constituting their outer ends, to the shell at spaced intervals around the inner surface of the shell adjacent the skirt thereof and at their inner ends to the head band at spaced intervals therealong for holding the head band spaced from the inner surface of the shell, each tension member being formed of inelastic and relatively inextensible strips material, with a portion of the strip material being formed for permitting extension and contraction of the tension member and having elastically deformable means associated therewith for enabling extension of the tension member within a limited range of extension upon tensioning thereof, whereby with the headgear worn by a wearer and upon application of an impact load to the front, back, or sides of the headgear, the shell moves relative to the head in the direction of the force with resultant tensioning and elongation of certain of the tension members, the range of elongation of the tension members being such as to prevent engagement of the shell with the wearer's head and the elastically deformable means of the elongated tension members deforming to attenuate the shock upon the wearer from the applied load, and whereby, upon termination of the impact load, the elongated tension members contract and the shell is moved in the opposite direction relative to the head, each tension member having a transversely extending pocket receiving the respective elastically deformable means therein, said deformable means being laterally squeezed upon extension of the tension member from an unstressed condition in which it holds the sides of the pocket apart to a generally flattened condition enabling elongation of the tension member, said tension members being constituted by a single relatively long length of said strip material secured to the shell and the head band at spaced intervals, and a plurality of relatively short lengths of said strip material, one short length for each pair of adjacent tension members, stitched to said relatively long length of strip material to form said pockets, one for each tension member.

2. A suspension system as set forth in claim 1 wherein each tension member extends inwardly from its point of attachment to the shell toward the head band at an angle relative to a central vertical plane of the headgear through said point of attachment.

3. A suspension system as set forth in claim 2 wherein successive tension members extend at opposite angles relative to central vertical planes of the headgear through the respective points of attachment of the members to the shell.

4. A suspension system as set forth in claim 1 wherein each tension member comprises two layers of the strip material stitched together at spaced locations to form said pocket for the tension member.

5. A suspension system as set forth in claim 4 wherein the strip material is fabric.

6. A suspension system as set forth in claim 1 wherein said elastically deformable means for each tension member comprises a tube of an elastomeric material.

7. A suspension as set forth in claim 6 wherein said tube is open at both ends thereof for exit of air on lateral squeezing of the tube.

8. A suspension system as set forth in claim 6 wherein the tube is cylindrical in its undeformed condition.

9. A suspension system as set forth in claim 8 wherein each tension member is formed of inelastically extensible strip material and has a transversely extending pocket receiving the tube, the tube having an outer diameter such as to provide a tight fit in the pocket.

10. A suspension system as set forth in claim 6 wherein the tube is of polyethylene.

11. A suspension system as set forth in claim 6 wherein the tube is of a polyarylate resin.

12. A suspension system as set forth in claim 6 wherein the tube is of a synthetic rubber.

13. A suspension system as set forth in claim 6 wherein the tube is of polyurethane.

14. A suspension system as set forth in claim 1 wherein the head band is of relatively inextensible strip material.

15. A suspension system as set forth in claim 14 wherein the strip material is fabric.

* * * * *